US009346057B2

(12) United States Patent
Urbinatti et al.

(10) Patent No.: US 9,346,057 B2
(45) Date of Patent: May 24, 2016

(54) TOP SUPPORTED MAINSHAFT SUSPENSION SYSTEM

(71) Applicant: Metso Minerals Industries, Inc., Waukesha, WI (US)

(72) Inventors: Victor G. Urbinatti, Waukesha, WI (US); Donald J. Polinski, Waukesha, WI (US)

(73) Assignee: Metso Minerals Industries, Inc., Waukesha, WI (US)

( * ) Notice: Subject to any disclaimer, the term of this patent is extended or adjusted under 35 U.S.C. 154(b) by 175 days.

(21) Appl. No.: 14/154,230

(22) Filed: Jan. 14, 2014

(65) Prior Publication Data

US 2015/0196918 A1 Jul. 16, 2015

(51) Int. Cl.
*B02C 2/04* (2006.01)
*B02C 2/06* (2006.01)

(52) U.S. Cl.
CPC . *B02C 2/04* (2013.01); *B02C 2/047* (2013.01); *B02C 2/06* (2013.01)

(58) Field of Classification Search
CPC ..... B02C 2/04; B02C 2/047; B02C 2/00; B02C 2/06
USPC ..... 241/207–209, 211–213
See application file for complete search history.

(56) References Cited

U.S. PATENT DOCUMENTS 2,079,882 A 5/1937 Traylor, Jr.
2,799,456 A 7/1957 Behr
2,820,596 A * 1/1958 Broman ..... 241/211
3,057,563 A * 10/1962 Behr ..... 241/37
3,300,149 A 1/1967 Lemardeley et al.
6,772,970 B2 8/2004 Davis et al.
8,070,084 B2 12/2011 Biggin et al.
2002/0088887 A1 7/2002 Davis et al.

OTHER PUBLICATIONS

Nordberg XP50 Brochure No. 0807-09-00-CGD, published 2000.
Nordberg XP50 Parts Reference Manual, published 2001.
International Search Report for PCT/US2015/010095 dated Mar. 17, 2015.

* cited by examiner

*Primary Examiner* — Alexander P Taousakis
*Assistant Examiner* — Leonel Vasquez
(74) *Attorney, Agent, or Firm* — Andrus Intellectual Property Law, LLP

(57) ABSTRACT

An adjustment and suspension system for supporting the mainshaft of a gyratory crusher within a stationary spider hub. The system includes a piston movable within the spider hub to adjust the vertical position of the mainshaft. A stop member positioned within the spider hub controls the maximum vertical movement of the piston within the spider hub. A drive assembly is used to adjust the vertical position of the stop member to limit the vertical position of the mainshaft. The mainshaft is supported by a vertical support bearing and a radial support bearing that are located separate from each other. The vertical position of the drive shaft is controlled by a supply of pressurized hydraulic fluid introduced into the spider hub to control the vertical position of the movable piston.

14 Claims, 5 Drawing Sheets

18
11
12
16
20
14
22
10
24

TOP SUPPORTED MAINSHAFT SUSPENSION SYSTEM

BACKGROUND OF THE INVENTION

The present disclosure generally relates to a rock crushing machine, such as a rock crusher of configurations commonly referred to as gyratory or cone crushers. More specifically, the present disclosure relates to a suspension system for adjustably supporting an upper end of a mainshaft of the gyratory crusher within a stationary spider hub of the gyratory crusher.

Rock crushing machines break apart rock, stone or other materials in a crushing cavity formed between a downwardly expanding conical mantle installed on a mainshaft that gyrates within an outer upwardly expanding frustoconically shaped assembly of concaves inside a crusher shell assembly. The conical mantle and the mainshaft are circularly symmetric about an axis that is inclined with respect to the vertical shell assembly axis. These axes intersect near the top of the rock crusher. The inclined axis is driven circularly about the vertical axis thereby imparting a gyrational motion to the mainshaft and mantle. The gyrational motion causes points on the mantle surface to alternately advance toward and retreat away from the stationary concaves. During retreat of the mantle, material to be crushed falls deeper into the cavity where it is crushed when motion reverses and the mantle advances toward the concaves.

A spider is attached to the upper edge of the crusher shell assembly, forming the top of a support structure for the mainshaft. The material to be crushed is typically dropped into the shell assembly and past abrasion resistant spider arm shields that are positioned over radially extending spider arms that are each joined to a central spider hub. After either passing by or contacting the spider arms or the spider hub, the material to be crushed falls into the crushing cavity. In currently available gyratory crushers, the spider hub includes a bushing that receives one end of the gyrating mainshaft.

During the extended use of the gyratory crusher, the liners formed on a stationary bowl begin to wear, which changes the size of the crushing gap. In order to compensate for this wear, the vertical position of the mainshaft assembly is adjusted, which allows the discharge setting of the crusher to remain constant.

Presently, the different styles of gyratory crushers either have a mainshaft supported at the bottom by a large hydraulic cylinder, which allows for adjustment of the shaft position from below the crusher, or a mechanical threaded suspension at the top of the mainshaft. Gyratory crushers with bottom supported suspension systems are difficult to maintain since the adjustment cylinder assembly is large and heavy and the discharge chamber under the crusher must be cleaned out before access to the adjustment mechanism is possible.

Top threaded suspension systems also require a difficult and time-consuming process in order to adjust the vertical position of the mainshaft. This adjustment process typically includes having to lift a very heavy mainshaft with an overhead crane to unload a split adjustment nut so that the adjustment nut can be manually threaded down further on the mainshaft threads, which would then raise the mainshaft vertical position.

In addition, gyratory crushers that feature hydraulic supported suspension systems for the mainshaft, such as in the Metso MK-II or the Nordberg XP50 gyratory crushers, suffer from additional problems when used to crush material with very hard ore properties. When a piece of such very hard material enters the crushing gap, the material can create a crushing force that forces the mainshaft upward, causing the mainshaft to jump, which is an undesirable condition. In addition, previously available hydraulic top suspension systems also typically include a moving pivot point between the mainshaft and the stationary bearings, which can become misaligned during use and adjustment.

Based upon the limitations associated with these two currently available adjustment systems for the mainshaft of a gyratory crusher, a need exists for an improved adjustment system that allows the vertical position to be more easily adjusted.

SUMMARY OF THE INVENTION

The present disclosure is directed to an adjustment and suspension system for adjustably supporting the mainshaft of a gyratory crusher. More specifically, the present disclosure relates to a hydraulically adjustable system that acts on an upper end of the mainshaft to adjust the vertical position of the mainshaft within the gyratory crusher.

The gyratory crusher constructed in accordance with the present disclosure includes a spider hub that is supported by a pair of spider arms that extend across the upper open end of the gyratory crasher. The spider hub receives and supports the mainshaft of the gyratory crusher during the gyratory movement of the mainshaft. The gyratory crusher further includes a movable piston that is positioned within the spider hub for receiving and supporting the upper end of the mainshaft. Vertical movement of the piston within the spider hub controls the vertical position of the mainshaft within the gyratory crusher.

The gyratory crusher further includes a hydraulic fluid chamber that receives a supply of pressurized hydraulic fluid. When the hydraulic fluid chamber receives the supply of pressurized hydraulic fluid, the piston moves within the spider hub to adjust the location and position of the mainshaft. The vertical position of movable piston within the spider hub is controlled by a stop member that is selectively positioned within the spider hub. The stop member can be adjusted to control the vertical position of the mainshaft within the spider hub.

In one embodiment of the disclosure, the stop member is a stop nut. The stop nut includes a series of external threads that engage a mating series of adjustment threads that are located within the spider hub. The threaded interaction between the stop nut and the series of threads within the spider hub allows rotation of the stop nut to adjust the vertical position of the stop nut within the spider hub.

In one embodiment of the disclosure, a drive member is coupled to the stop nut such that operation of the drive member rotates the stop nut within the spider hub. In one embodiment of the disclosure, the drive member includes a drive ring that is coupled to the stop nut through a series of studs. The outer circumference of the drive ring is engaged by a drive gear rotatable through a drive shaft. Rotation of the drive shaft results in rotation of the drive ring, which in turn rotates the stop nut relative to the spider hub.

When the vertical position of the mainshaft is to be adjusted, the supply of hydraulic fluid used to support the movable piston within the spider hub is removed. Upon removal of the hydraulic fluid, the piston moves downward and out of contact with the adjustable stop nut. Once the piston has been moved out of contact with the stop nut, the drive member is used to rotate the stop nut to adjust the vertical position of the stop nut within the spider hub. The direction of rotation of the drive member controls whether the stop nut is moved vertically upward or downward within the spider hub.

Once the vertical position of the stop nut has been adjusted, the supply of pressurized hydraulic fluid is returned to the hydraulic fluid chamber. The pressurized supply of hydraulic fluid causes the piston to move upward, thereby adjusting the vertical position of the mainshaft. The piston moves upward until a top surface of the piston contacts a bottom surface of the stop nut. In this manner, the position of the stop nut controls the vertical position of both the piston and mainshaft.

The gyratory crusher further includes a vertical support bearing that is positioned within the piston to vertically support the upper end of the mainshaft. The vertical support bearing moves along with the piston and thus provides stable support for the upper end of the mainshaft in addition to eliminating the mainshaft from jumping during operation.

A second, separate radial support hearing is mounted between an outer surface of the mainshaft and the spider hub. The radial support bearing supports the radial forces created during the gyrational movement of the mainshaft. The radial support bearing is vertically stationary such that the mainshaft moves relative to the radial support bearing. The separation of the vertical support bearing and the radial support bearing allows the radial support bearing to function as a fixed pivot point for the mainshaft within the gyratory crusher.

Various other features, objects and advantages of the disclosure will be made apparent from the following description taken together with the drawings.

BRIEF DESCRIPTION OF THE DRAWINGS

The drawings illustrate the best mode presently contemplated of carrying out the disclosure. In the drawings.

DETAILED DESCRIPTION OF THE INVENTION

Figure 1:
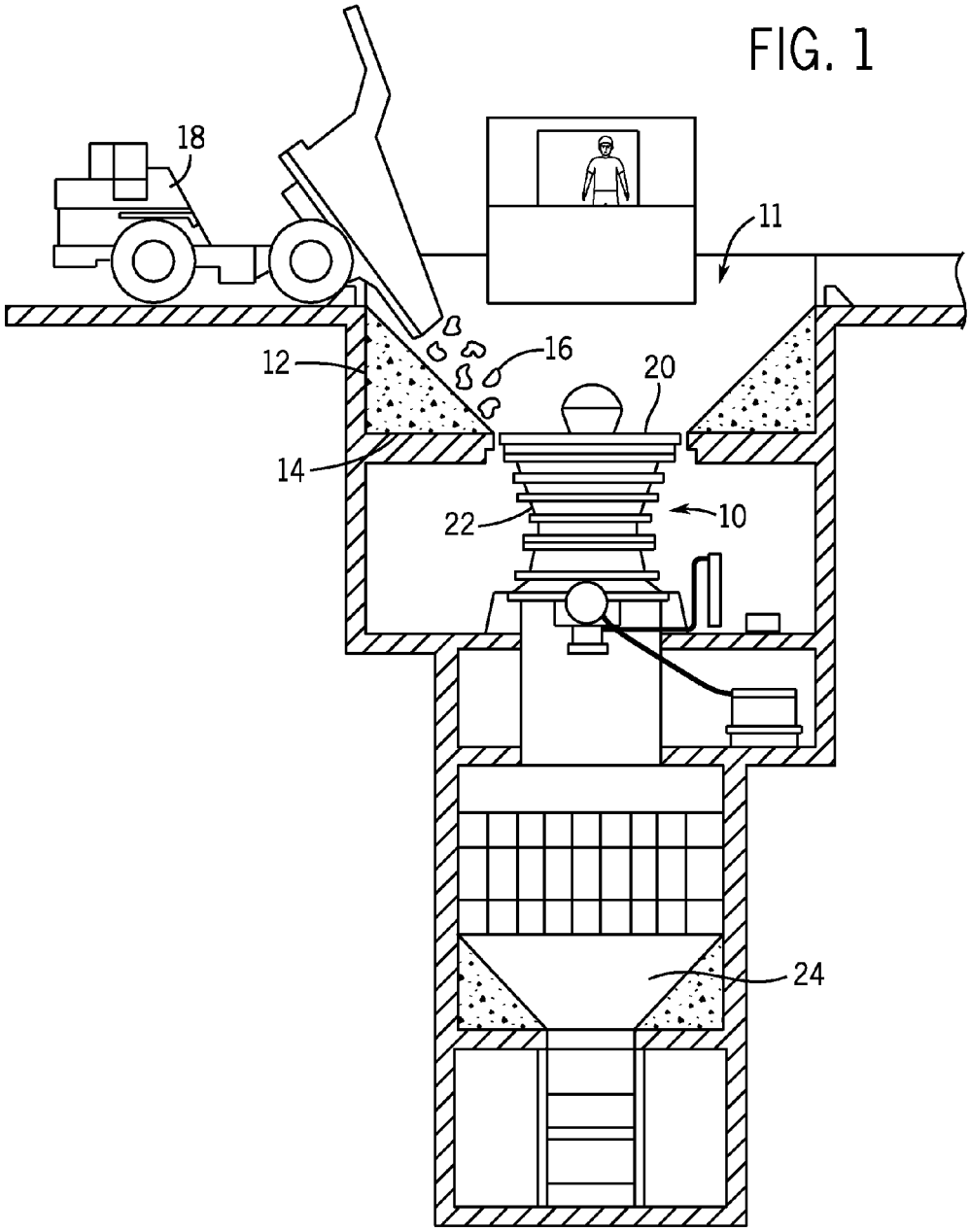
FIG. 1 is a schematic illustration of a gyratory rock crusher.

FIG. 1 illustrates the general use of a rock crushing system 11. As illustrated in FIG. 1, a gyratory rock crusher 10 is typically positioned within a pit 12 having a bottom wall 14. The pit 12 receives a supply of material 16 to be crushed from various sources, such as a haul truck 18. The material 16 is deposited into the pit 12 and is directed toward the top of a crushing cavity positioned below the upper feed end 20 of the rock crustier 10. The material 16 enters the crushing cavity and passes through the concave assembly positioned along the stationary shell assembly 22. Within the shell assembly, a crushing mantle (not shown) gyrates and crushes the material within the crushing cavity. The crushed material exits the gyratory rock crusher 10 and enters into a receiving chamber 24 where the crushed material is then directed away from the rock crushing system 11, such as through a conveyor assembly or other transportation mechanisms. The operation of the rock crushing system 11 is conventional and has been utilized for a large number of years.

Figure 2:
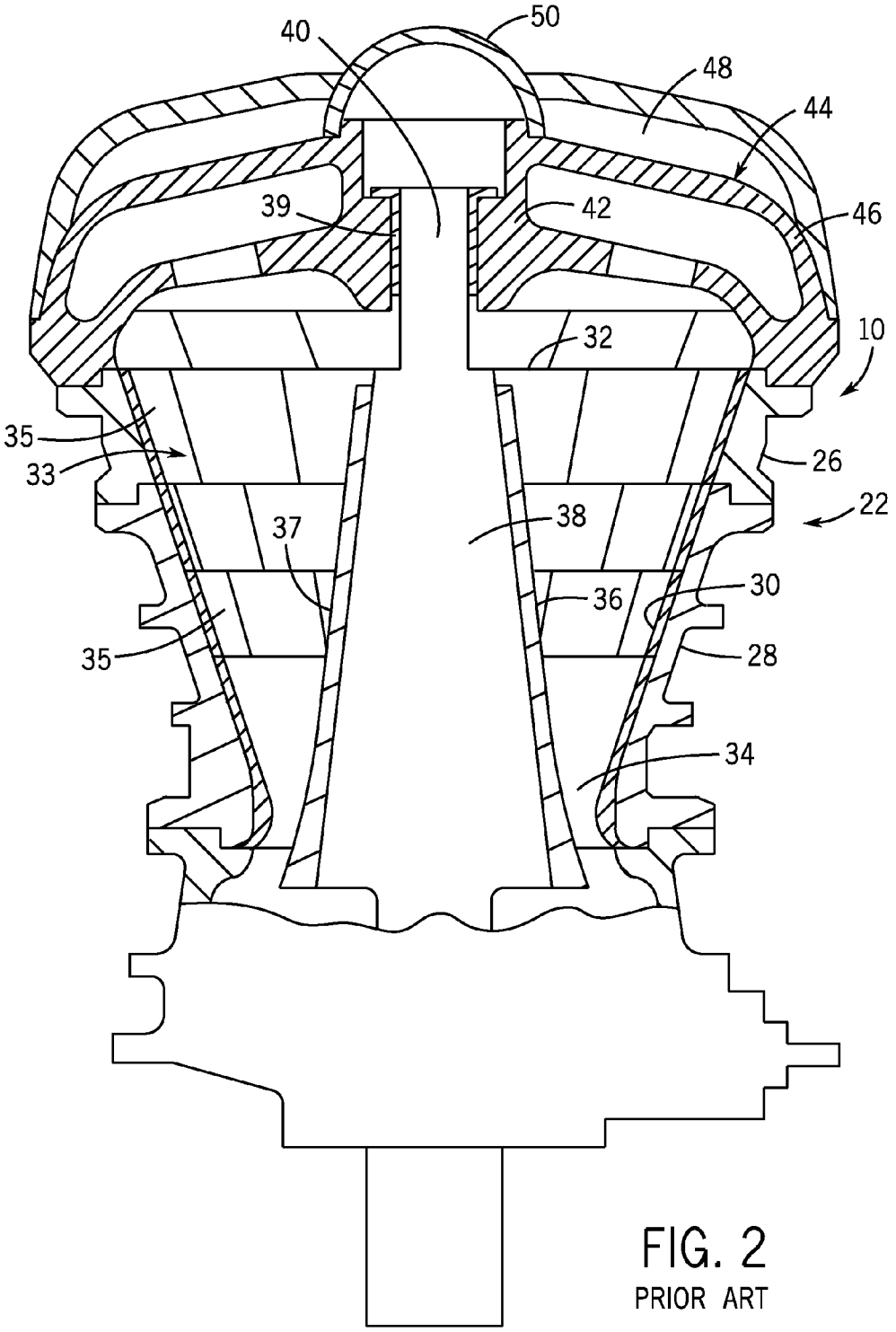
FIG. 2 PRIOR ART
FIG. 2 is a section view of a prior art gyratory rock crusher including a prior art spider.

FIG. 2 illustrates a cross-section view of the gyratory rock crusher 10 of the prior art. As illustrated in FIG. 2, the gyratory rock crusher 10 typically includes the shell assembly 22 formed by an upper top shell 26 joined to a top shell 28. The rows of concaves 35 positioned along the inner surface of the shell assembly 22 define a generally tapered frustoconical inner surface 30 that directs material from the open top end 32 downward through a converging crushing cavity 33 formed between the inner surface 30 defined by the rows of concaves 35 and an outer surface 36 of a frustoconical mantle 37 positioned on a gyrating mainshaft 38. Material is crushed over the height of the crushing cavity 33 between the inner surface 30 and the outer surface 36 as the mainshaft 38 gyrates, with the final crushing at the crushing gap 34.

The upper end 40 of the mainshaft 38 is supported in a bushing 39 contained within a central spider hub 42 of a spider 44. The spider 44 is mounted to the upper top shell 26 and includes at least a pair of spider arms 46 that support the central spider hub 42, as illustrated. In the embodiment illustrated, a pair of spider arm shields 48 are each mounted to the spider arms 46 to provide wear protection. A spider cap 50 mounts over the central spider hub 42, as illustrated.

The gyratory rock crusher 10 shown in FIG. 2 represents a prior art crusher in which the mainshaft 38 is adjustably supported at its lower end to selectively adjust the size of the crushing gap 34 upon wear to the concaves 35 and the mantle 37.

Figure 3:
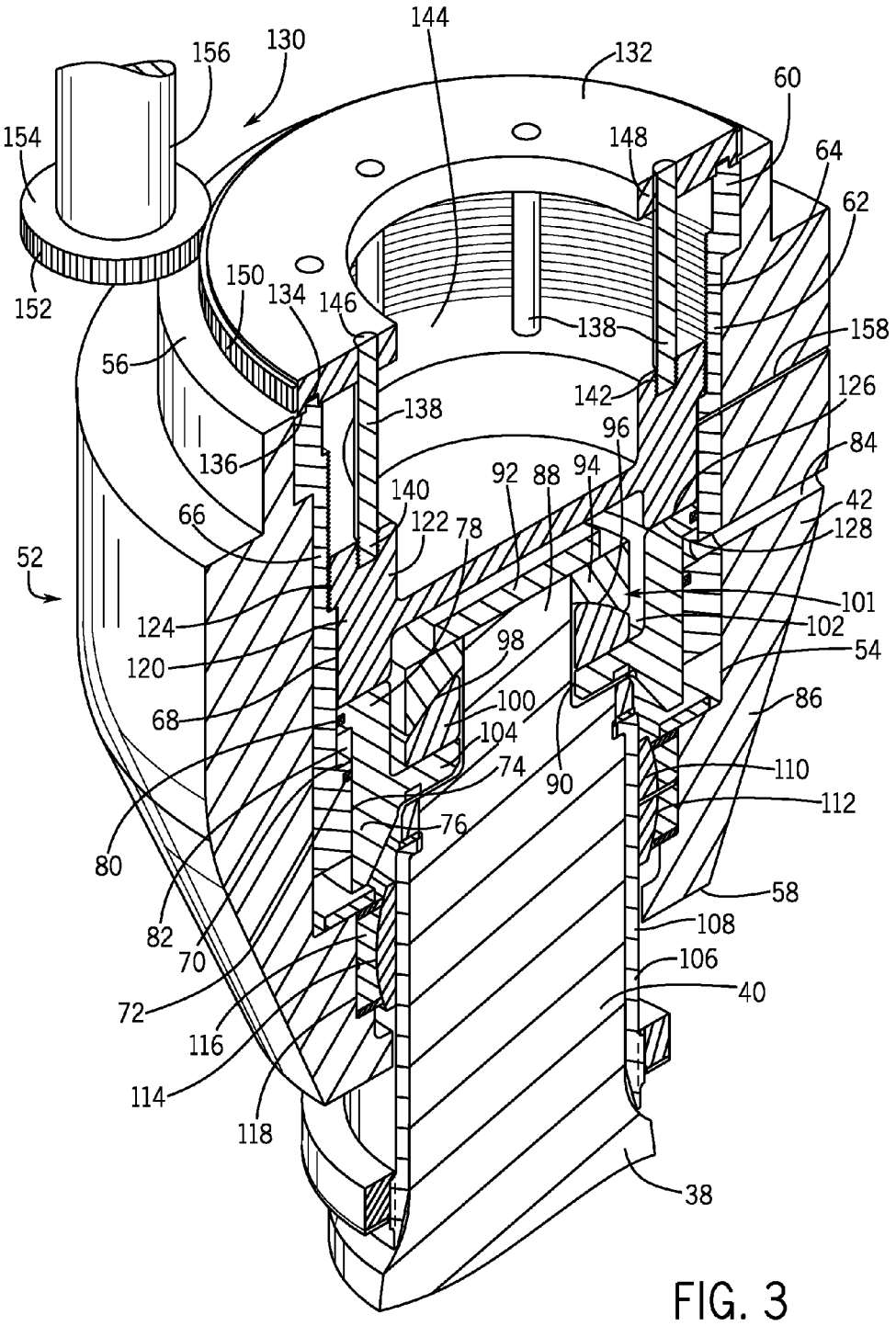
FIG. 3 is an isometric, sectional view of the hydraulic adjustment system used to adjust the vertical position of the mainshaft in accordance with the present disclosure.

FIG. 3 illustrates the adjustment and suspension system of the present disclosure. The hydraulic adjustment and suspension system is operable to adjust the Vertical position of the upper end 40 of the mainshaft 38 relative to the Stationary central spider hub 42. In the embodiment shown in FIG. 3, the central spider hub 42 is shown without either of the pair of spider arms that are used to support the spider hub 42 relative to the open top end 32 of the gyratory rock crusher 10, as illustrated in the prior art embodiment of FIG. 2. It should be understood that the adjustment and suspension system of the present disclosure is formed in the central spider hub 42 shown in FIG. 2.

Referring back to FIG. 3, the spider hub 42 includes an internal cavity 54 that extends into the spider hub 42 from upper end 56. The internal cavity 54 extends entirely through the spider hub 42 to the lower end 58. As illustrated in FIG. 3, the upper end 40 of the mainshaft 38 is supported within the internal cavity 54 and extend through the lower end 58.

The internal cavity 54 receives a suspension bushing 60 that extends into the internal cavity 54 from the upper end 56. The suspension bushing 60 includes an upper section 62 having a series of adjustment threads 64. A lower section 66 is defined by a smooth inner wall 68 and includes a radially inwardly extending shoulder 70. A lower hydraulic seal 72 is received within a recessed groove formed slightly below the shoulder 70. In the embodiment illustrated, the lower hydraulic seal 72 is formed from a resilient material.

The lower hydraulic seal 72 engages an outer surface 74 of a movable piston 76. The movable piston 76 includes an upper flange 78 that extends radially outward past the outer surface 74 and includes an upper hydraulic seal 80. The upper hydraulic seal 80 contacts the smooth inner wall 68 of the suspension bushing 60.

As illustrated in FIG. 3, a hydraulic fluid chamber 82 is created between the flange 78 formed on the piston 76 and the shoulder 70 defined by the suspension bushing 60. The hydraulic fluid chamber 82 extends around the entire outer periphery of the piston 76. The lower hydraulic seal 72 and the upper hydraulic seal 80 are positioned and function to prevent the flow of hydraulic fluid out of the hydraulic fluid chamber 82.

A hydraulic fluid inlet 84 extends through the solid outer wall 86 of the spider hub 42 to provide a fluid flow passageway for hydraulic fluid to travel from a pressurized source (not shown) into the hydraulic fluid chamber 82. The fluid inlet includes a pressure fitting that allows the fluid inlet to be connected to the supply of hydraulic fluid. The fluid inlet can include an accumulator or pressure relief valve (not shown) positioned between the supply of hydraulic fluid and the hydraulic fluid chamber 82 to limit the pressure of the hydraulic fluid within the chamber 82. The accumulator or pressure relief valve provides for overload protection during a tramp event. In such a tramp event, the mainshaft moves downward and reduces the size of the hydraulic fluid chamber 82, thereby increasing the pressure of the hydraulic fluid within the hydraulic fluid chamber 82. The accumulator or pressure relief valve connected to the fluid inlet releases a portion of the hydraulic fluid, thereby reducing the shock on the other components of the system.

As illustrated in FIG. 3, the upper end 40 of the mainshaft 38 includes a reduced diameter stem 88 that extends through a central opening 90 formed in the piston 76. When the stem 88 is positioned as shown, the top end of the stem is secured to a support ring seat retainer 92. Typically, the stem 88 is connected to the seat retainer 92 by a series of connectors, although other methods of attachment are contemplated. The seat retainer 92, in turn, is connected to a spherical support ring seat 94. The ring seat 94 includes a dished lower contact surface 96 that engages a corresponding curved upper contact surface 98 of a spherical support ring 100. The combination of the ring seat 94 and support ring 100 forms a vertical support bearing 101 that is positioned between the piston 76 and the stem 88 of the mainshaft 38. The vertical support bearing 101 supports vertical thrust loads exerted by the mainshaft during gyrational movement. The vertical support bearing 101 is generally contained within an upper cavity 102 of the piston 76 that is defined at its lower end by the center flange 104. The inner edge of the center flange 104 defines the opening 90 that receives the stem 88 of the mainshaft 38.

The upper end 40 of the mainshaft 38 further includes a mainshaft sleeve 106. The mainshaft sleeve 106 includes an outer surface 108 that passes through a spherical radial support bearing 110. The radial support bearing 110 includes a curved outer surface 112 that engages a corresponding dish-like outer surface 114 of a support block 116. The support block 116 is securely mounted within a bearing cavity 118 formed within the outer wall 86 of the spider hub 42. The combination of the support block 116 and the radial support bearing 110 allows the mainshaft 38 to gyrate relative to the stationary spider hub 42 and provides radial support for such movement. The interaction between the support block 116 and the radial support bearing 110 defines a fixed pivot point for the mainshaft 38 as the mainshaft 38 gyrates within the gyratory crusher.

As illustrated in FIG. 3, the adjustment and suspension system of the present disclosure includes a stop member 120 that is selectively movable relative to the stationary spider hub 42. In the embodiment illustrated, the stop member 120 is a stop nut 122. The stop nut 122 includes a series of external threads 124 that are received along the series of adjustment threads 64 formed on the suspension bushing 60. In this manner, rotation of the stop nut 122 allows the stop nut 122 to move vertically along the series of adjustment threads 64.

The stop nut 122 includes a lower contact surface 126. The lower contact surface is an annular surface that engages a corresponding annular top contact surface 128 of the movable piston 76. The physical contact between these two surfaces limits the vertical movement of the piston 76.

The vertical position of the stop nut 122 relative to the stationary spider hub 42 is controlled by a driving arrangement 130. The driving arrangement 130, when activated, rotates the stop nut 122 in either the counter-clockwise or clockwise direction to selectively move the stop nut 122 vertically in either direction along the series of adjustment threads 64. Various different physical arrangements can be utilized to function as the driving arrangement 130 of the present disclosure. However, it is contemplated that the driving arrangement 130 will be an automated mechanical device, as illustrated.

In the embodiment shown in FIG. 3, the driving arrangement 130 includes a drive ring 132 positioned to rotate along the stationary upper end 56 of the spider hub 42. The drive ring 132 includes a locator groove 134 that receives an upper tab 136 formed on the suspension bushing 60. The interaction between the locator groove 134 and the upper tab 136 limits the radial movement of the drive ring 132 along the upper end 56 of the spider hub 42.

The drive arrangement 130 further includes a plurality of drive ring studs 138. Each of the drive ring studs 138 includes a threaded lower end 140 that is received within a corresponding threaded cavity 142 extending into the stop nut 122 from the top wall 144. The top end 146 of each drive ring stud 138 is received within a cavity 148 formed in the drive ring 132. When the drive ring 132 rotates, the rotational movement of the drive ring 132 is imparted to the stop nut 122 through the series of spaced drive ring studs 138.

As illustrated in FIG. 3, the outer circumferential edge of the drive ring 132 includes a series of teeth 150 that mesh with a corresponding series of teeth 152 formed on a drive gear 154. The drive gear 154, in turn, is mounted to a drive shaft 156. Although not shown, the drive shaft 156 is coupled to a drive motor that can be selectively operated in either direction. Thus, when it is desired to adjust the vertical position of the stop nut 122, the drive shaft 156 is rotated in the appropriate direction, which results in rotation of the drive gear 154. The teeth 152 contained on the drive gear 154 engage the teeth 150 formed along the outer circumferential edge of the drive ring 132, thereby causing rotation of the drive ring 132. The rotational movement of the drive ring 132 is imparted to the stop nut 122 through the plurality of drive ring studs 138. In this manner, the operation of the drive motor can selectively adjust the vertical position of the stop nut 122.

The adjustment and suspension system 52 further includes a fluid outlet 158 formed in the outer wall 86 of the spider hub 42. The fluid outlet 158 limits the maximum travel of the piston 76. Specifically, when the upper hydraulic seal 80 travels past the fluid outlet 158, the hydraulic fluid contained within the fluid chamber 82 is discharged into the fluid outlet 158. In this manner, the fluid outlet 158 limits the amount of vertical travel of the piston 76.

FIGS. 4-7 illustrate the operation of the hydraulic adjustment and suspension system of the present disclosure to adjust the vertical position of the mainshaft 38 relative to the stationary spider hub 42.

Figure 4:
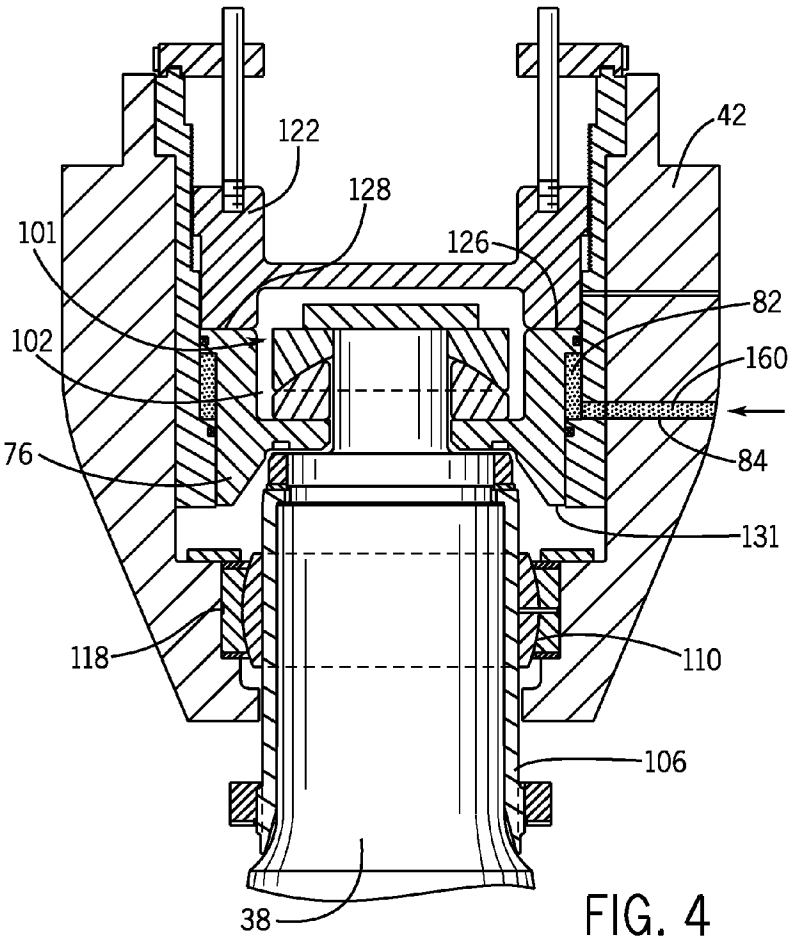
FIG. 4 is a section view of the hydraulic suspension system illustrating the introduction of pressurized hydraulic fluid.
Figure 7:
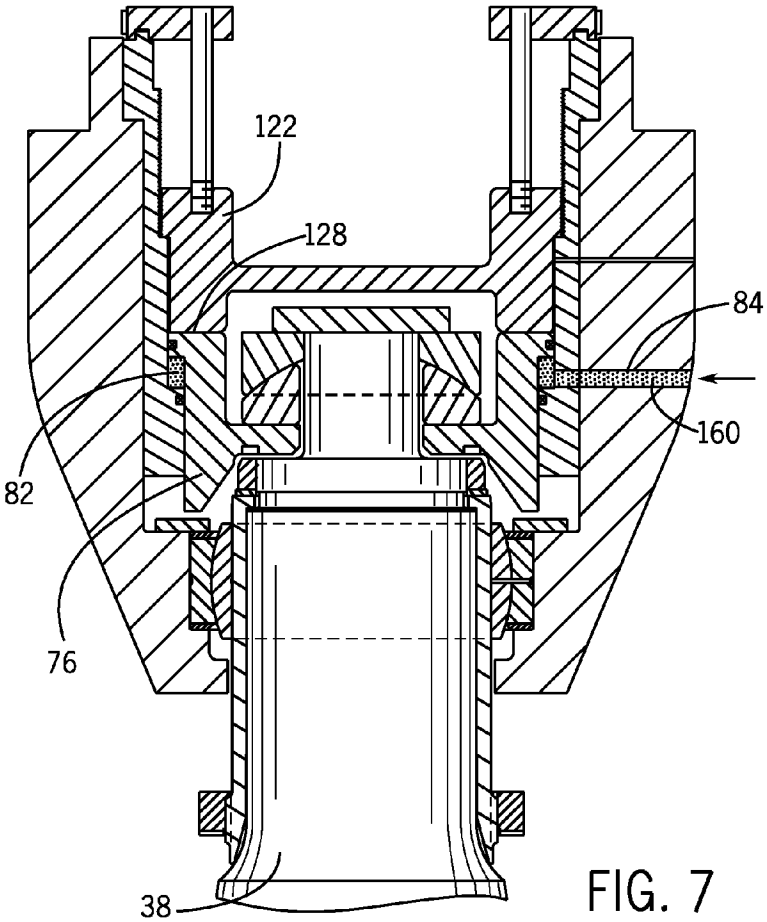
FIG. 7 is a section view illustrating the reintroduction of the pressurized hydraulic fluid to vertically move the mainshaft.

As shown in FIG. 4, the vertical position of the mainshaft 38 is controlled by the hydraulic fluid 160 supplied to the fluid chamber 82 through the fluid inlet 84. When the pressure of the hydraulic fluid contained within the fluid chamber 82 is sufficient, the fluid pressure urges the piston 76 upward until the top contact surface 128 of the piston engages the lower contact surface 126 of the stop nut 122. In this manner, the position of the stop nut 122 relative to the stationary spider hub 42 controls the vertical position of the mainshaft 38. During this initial vertical movement, the mainshaft sleeve 106 moves relative to the spherical radial support bearing 110 stationarily supported within the bearing cavity 118 defined within the spider hub 42.

As the piston 76 moves upwardly, the vertical support bearing 101 contained within the upper cavity 102 moves upward while continuing to support the upper end of the mainshaft 38. In this manner, the vertical support bearing 101 moves along with the piston while the radial support hearing 110 remains stationary and the mainshaft moves relative to the radial support bearing 110.

Figure 5:
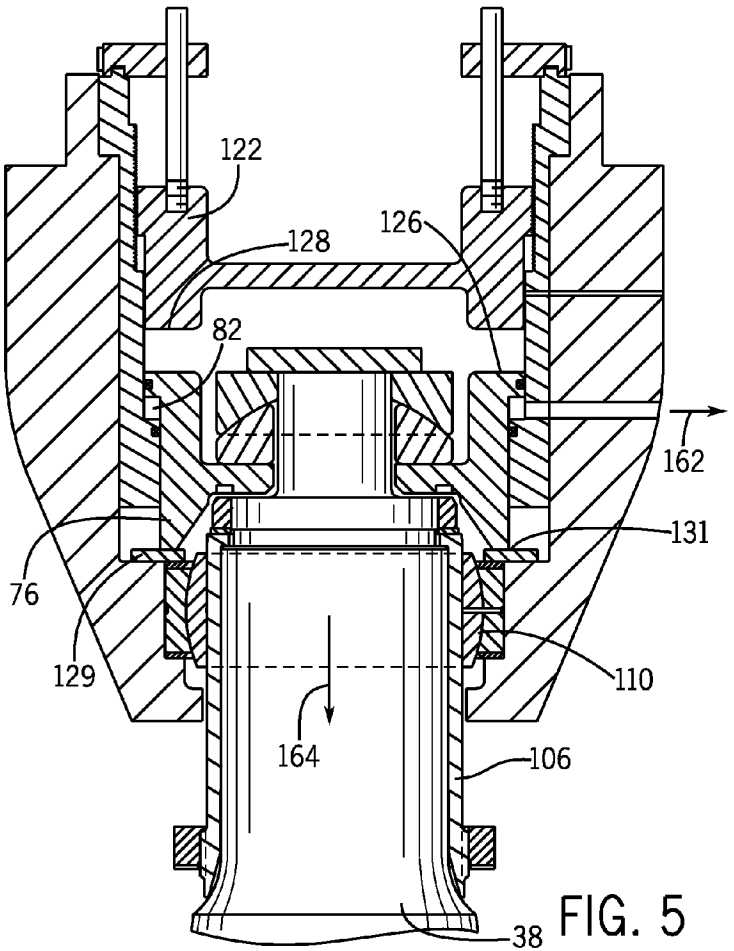
FIG. 5 is a section view illustrating the removal of the pressurized hydraulic fluid.

If an adjustment to the mainshaft vertical position is desired, the hydraulic fluid is discharged from the fluid chamber 82, as illustrated by arrow 162 in FIG. 5. Once the hydraulic fluid has been discharged, the weight of the mainshaft 38 and its associated components causes the mainshaft 38 to move downward, as illustrated by arrow 164. During this movement, the size of the fluid chamber 82 decreases, as can be seen in a comparison of FIGS. 4 and 5.

As illustrated in FIG. 5, the lowest vertical position of the piston 76 is controlled by a contact ring 129. The bottom edge 131 of the piston 76 physically contacts the contact ring 129 to support the piston as well as the entire mainshaft 38 in the lowermost position shown in FIG. 5.

On the piston 76 is in the retracted position shown, a significant separation exists between the top contact surface 126 of the piston 76 and the lower contact surface 128 of the stop nut 122. During this movement, the sleeve 106 on the mainshaft 38 moves through the radial support bearing 110 as previously described.

Figure 6:
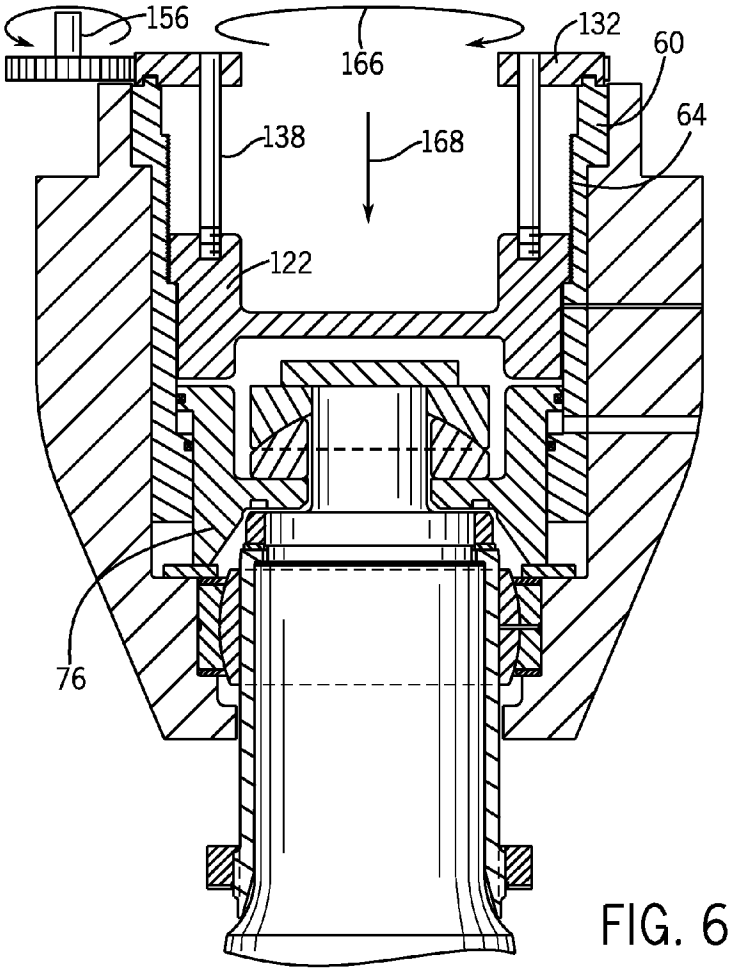
FIG. 6 is a section view illustrating the adjustment of the stop nut.

As previously described, the vertical movement of the piston 76 is controlled by the vertical position of the stop nut 122 along the adjustment threads 64 formed as part of the suspension bushing 60, as shown in FIG. 6. The adjustment of the stop nut 122 is carried out by causing rotation of the drive shaft 156, which in turn rotates the drive ring 132. Rotation of the drive ring 132 in the direction shown by arrow 166 causes a corresponding rotation in the stop nut 122 through the connection created by the chive ring studs 138. This rotation causes the stop nut 122 to move downward, as indicated by arrow 168.

Once the stop nut 122 is in its desired, adjusted position shown in FIG. 6, hydraulic fluid is again supplied to the fluid chamber 82 through the fluid inlet 84. The supply of pressurized hydraulic fluid 160 creates an upward force on the piston 76, which causes the piston 76 to move upward into contact with the lower contact surface 128. In this manner, the vertical position of the mainshaft 38 can be controlled and adjusted.

As described previously, the adjustment and suspension system of the present disclosure includes separate spherical bearings for supporting the radial and vertical thrust loads exerted by the mainshaft. The use of separate spherical bearings for supporting the vertical and radial thrusts allows the alignment between the lower journal of the mainshaft and the lower eccentric bushing to be maintained regardless of the vertical position of the mainshaft. In previously available top supported crushers in which the mainshaft is adjusted to compensate for wear via a hydraulic mechanism, the adjustment-induced misalignment in the lower eccentric bushing would then reduce the load carrying capabilities of the journal bearing.

In the embodiment illustrated, the drive motor used to impart rotational movement on the drive ring 132 can be either an electric or hydraulic motor housed within the crusher spider arm. A single drive shaft or a dual drive shaft can be used to rotate the adjustment drive ring depending upon the power needed to make such adjustments. A brake function in the hydraulic or electric motor will be used to prevent the drive ring from rotating during normal crushing operation.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

We claim:

1. A gyratory crusher comprising:

a spider hub;

a suspension bushing mounted within the spider hub;

a mainshaft having an upper end supported within the spider hub;

a movable piston positioned within the spider hub for receiving and supporting the upper end of the mainshaft;

a hydraulic fluid chamber that receives a supply of pressurized hydraulic fluid, wherein the hydraulic fluid chamber is formed between the piston and the suspension bushing such that the receipt of the supply of pressurized hydraulic fluid within the hydraulic fluid chamber moves the piston relative to the spider hub; and a stop member movable along the suspension bushing, wherein the stop member physically contacts the piston to limit the movement of the piston.

2. The gyratory crusher of claim 1 wherein the stop member is a stop nut selectively movable along a portion of the suspension bushing to selectively limit the upward movement of the piston within the spider hub.

3. The gyratory crusher of claim 2 wherein the stop nut includes a series of threads that engage a mating series of threads formed on the suspension bushing such that the rotation of the stop nut within the suspension bushing moves the stop nut relative to the spider hub.

4. The gyratory crusher of claim 3 further comprising a drive member coupled to the stop nut, wherein the drive member is operable to rotate the stop nut within the suspension bushing.

5. The gyratory crusher of claim 4 wherein the drive member includes a drive ring coupled to the stop nut and a drive gear mounted to a drive shaft, wherein rotation of the drive shaft rotates the stop nut through the drive ring and the drive gear.

6. The gyratory crusher of claim 1 further comprising:

a vertical support bearing positioned within the piston to vertically support the upper end of the mainshaft; and a radial support bearing mounted between an outer surface of the mainshaft and the spider hub, wherein the radial support bearing defines a fixed pivot point for the mainshaft.

7. The gyratory crusher of claim 6 wherein the radial support bearing is stationary relative to the vertical movement of the mainshaft.

8. The gyratory crusher of claim 1 wherein the stop member is a stop nut having a series of external threads that engage a series of mating threads formed on the suspension bushing such that rotation of the stop nut relative to the suspension bushing moves the stop nut vertically relative to the suspension bushing.

9. A gyratory crusher, comprising:

a stationary spider hub;

a suspension bushing mounted within the spider hub;

a piston movably positioned within the suspension bushing mounted within the stationary spider hub;

a mainshaft having an upper end supported by the piston such that the mainshaft is vertically movable with the piston;

a hydraulic fluid chamber formed between the suspension bushing and the piston, wherein the hydraulic fluid chamber receives a supply of pressurized hydraulic fluid to selectively move the piston relative to the stationary spider hub;

a stop member movable along the suspension bushing, wherein the stop member physically contacts the piston to limit the vertical movement of the piston;

a vertical support bearing positioned within the piston to vertically support the upper end of the mainshaft; and a radial support bearing mounted between an outer surface of the mainshaft and the spider hub.

10. The gyratory crusher of claim 9 wherein the radial support bearing is stationary relative to the vertical movement of the mainshaft.

11. The gyratory crusher of claim 9 wherein the vertical support bearing and the radial support bearing are separate from each other.

12. The gyratory crusher of claim 9 wherein the vertical support bearing is movable with the piston.

13. The gyratory crusher of claim 9 wherein the stop member is a stop nut having a series of external threads that engage a series of mating threads formed on the suspension bushing such that rotation of the stop nut relative to the suspension bushing moves the stop nut vertically relative to the suspension bushing.

14. The gyratory crusher of claim 13 further comprising a drive member coupled to the stop nut, wherein the drive member is operable to rotate the stop nut within the spider hub.

* * * * *